US008920096B2

(12) United States Patent
Donselman

(10) Patent No.: US 8,920,096 B2
(45) Date of Patent: Dec. 30, 2014

(54) BOOK BINDING ADHESIVE APPLICATION CONTROLLER

(71) Applicant: Donnie Donselman, Danville, KY (US)

(72) Inventor: Donnie Donselman, Danville, KY (US)

( * ) Notice: Subject to any disclaimer, the term of this patent is extended or adjusted under 35 U.S.C. 154(b) by 13 days.

(21) Appl. No.: 13/904,338

(22) Filed: May 29, 2013

(65) Prior Publication Data

US 2014/0186142 A1 Jul. 3, 2014

Related U.S. Application Data

(63) Continuation-in-part of application No. 13/727,716, filed on Dec. 27, 2012, now abandoned.

(51) Int. Cl.
*B42C 9/00* (2006.01)
*B42C 99/00* (2006.01)

(52) U.S. Cl.
CPC ..... *B42C 9/0012* (2013.01); *B42C 99/00* (2013.01); *B42C 9/0031* (2013.01)
USPC ..... 412/37

(58) Field of Classification Search
CPC ..... B42C 9/00; B42C 9/0012; B42C 9/0006
USPC ..... 412/37
See application file for complete search history.

(56) References Cited

U.S. PATENT DOCUMENTS

| | | | | |
|---|---|---|---|---|
| 2,984,378 | A | 5/1961 | Gunter | |
| 3,030,262 | A | 4/1962 | Gunter | |
| 3,364,092 | A | 1/1968 | Hawkes et al. | |
| 3,866,568 | A | 2/1975 | Minami | |
| 3,980,514 | A | 9/1976 | Rosette et al. | |
| 4,014,287 | A * | 3/1977 | Green | 118/696 |
| 4,335,674 | A * | 6/1982 | Winker et al. | 118/110 |
| 5,443,639 | A * | 8/1995 | Hawkes | 412/37 |
| 5,716,182 | A | 2/1998 | Leu | |
| 6,503,040 | B1 * | 1/2003 | Abegglen et al. | 412/37 |
| 6,565,658 | B2 | 5/2003 | Fischer et al. | |
| 6,908,513 | B2 | 6/2005 | Henke | |
| 7,959,394 | B2 | 6/2011 | Abeddlen et al. | |
| 2003/0215309 | A1 * | 11/2003 | Engert et al. | 412/7 |
| 2007/0286706 | A1 | 12/2007 | Takagi | |
| 2008/0003080 | A1 * | 1/2008 | Abegglen et al. | 412/37 |
| 2011/0008133 | A1 * | 1/2011 | Walther et al. | 412/37 |

FOREIGN PATENT DOCUMENTS

DE 240525 A1 5/1986

* cited by examiner

*Primary Examiner* — Kyle Grabowski
(74) *Attorney, Agent, or Firm* — Michael Coblenz

(57) ABSTRACT

A device for controlling the application of glue on the spine of a book. The device consists of a computerized controller that tracks the precise location of the book in the binding system, and a servo motor that controls a doctor blade, the servo motor is connected to the controller and is instructed when to open or close the doctor blade at the precise time to precisely place the glue on the book spine. The doctor blade can also be adjusted to control the thickness of the glue on the book spine.

11 Claims, 7 Drawing Sheets

BOOK BINDING ADHESIVE APPLICATION CONTROLLER

CROSS REFERENCE TO RELATED APPLICATIONS

This application is a continuation in part of U.S. provisional application No. 61/580,910, filed on Dec. 28, 2011, and a continuation in part of U.S. application Ser. No. 13/727,716, filed on Dec. 27, 2012, both incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a device for controlling the application of glue to the binding of a book or magazine during the book binding process. More specifically the device relates to a computer controlled servo-motor and cam that can precisely adjust the distance from a doctor blade to the glue wheel to precisely control the thickness, and the spatial application, of the glue applied during the book binding process.

2. Description of the Related Art

The process of book binding is well know and the subject of numerous patents. See, for example, U.S. Pat. No. 3,866,568 issued to Minami on Feb. 18, 1975, and U.S. Pat. No. 4,014,287 issued to Green on Mar. 29, 1977 for general information on the book binding process. One of the main steps in bookbinding involves the application of an adhesive to the backbone of the assembled pages of a book or magazine. As used herein, the term bookbinding applies to the binding of any print publication, including books, magazines and catalogues, and the term book is used to refer to the material being bound, whether a book, a magazine, or a catalogue. The adhesive is typically glue, and most commonly the glue is made from petroleum based products. In modern bookbinding it is common to use "hot glue" or glue that is heated and that solidifies when it cools. This form of glue solidifies much quicker than other types of glues. The glue is applied to the book back, often called the spine, of the book by running the spine over a glue wheel or series of glue wheels which are covered with glue that is applied to the spine.

The application of the glue to the backbone is accomplished by means of glue wheels, which typically obtain the glue from a glue pot. The glue pot is a vessel that holds the liquid glue. Generally a portion of the glue wheel sits in the reservoir of glue and as it rolls the outer surface of the glue wheel picks up glue from the pot and transfers the glue to the top of the wheel. The back of the book, which is often referred to as the spine or backbone, is run over the top of the glue wheel to apply the glue. Typically the spine is pressed against the first glue wheel as it rolls across, which forces the pages apart slightly and allows the glue to spread between the pages. It is important to apply the appropriate amount of glue to the book back. If too little glue is applied the pages may not be properly bonded and the book may fall apart, and if too much glue is applied the pages might stick at an inconvenient distance from the spine and prevent the pages from opening. Glue is often the most expensive component of the book binding process, and the use of excess glue leads to waste, which will increase the cost of the binding process. There is the need, therefore, for a system to precisely control the amount of glue on the glue wheel to ensure sufficient glue to properly bind the book, while minimizing the amount of glue used and minimizing waste.

Another commonly encountered problem is that glue may be applied to too much of the spine. In old systems the glue wheel was entirely covered with glue, and the book back would pick up glue from the leading edge to the trailing edge. In general it is not desirable to get glue on the ends of the book back. There are a couple of reasons for this. One reason is that this glue may seep up between the pages and make the pages stick. One other reason is that it is a waste of glue. This is particularly true in binding magazines, where the ends of the bound book are trimmed off. If there is glue on the ends of the book back and pages it will be trimmed off, and will be totally wasted.

A device, known in the art of bookbinding as the doctor blade, is used to control the amount of glue on the wheel and which thus can be imparted onto the spine of the book. An example of a prior art doctor blade can be seen in U.S. Pat. No. 6,565,658 issued to Fischer et al., on May 20, 2003. The earliest doctor blades were fixed and therefore only controlled the thickness of the glue on the glue wheel. Modern doctor blades can move, reciprocating into and away from the glue wheel, from an open position where glue is allowed on the glue wheel, to a closed position, which is close enough to the glue wheel to essentially scrape the glue off the glue wheel and prevent glue from contacting the book back. Prior art doctor blades were typically controlled by a cam drive linkage that was attached to the drive mechanism of the machinery that moved the books through the binder. This system is not precise, and can allow too much or too little glue on the wheel, and also cannot be precisely controlled to prevent glue from adhering to the ends of the spine. There is a need, therefore, for a system to precisely control the thickness of the glue on the glue wheel.

SUMMARY OF THE INVENTION

The invention consists of a doctor blade that is precisely controlled to limit or control the application of glue to the spine of the book. The doctor blade is precisely controlled by a linkage attached to a servo motor with a cam, and the servo motor is controlled by a computerized control system to precisely time and position the doctor blade. This allows the doctor blade to control the thickness of the glue placed on the spine, and also controls the doctor blade to control the spatial placement of the glue along the spine.

The invention is a precisely controlled doctor blade that precisely controls the application of glue on the spine by controlling the glue on the glue wheel by controlled movement of the doctor blade. The doctor blade is moved by a servo motor attached to the doctor blade by a linkage. The servo motor is controlled by a computer operating system that can move the doctor blade based on the length of the spine and the desired placement of glue on the spine. The operating system operates based on information inputted by an operator, and also works with an electric eye that provides information on movement of the books in the binder so that the doctor blade opens and closes as the desired time to place glue in the precise location on the spine. The electric eye also allows the system to deal with a missing book, and prevents the doctor blade from opening, and thus applying glue to the wheel, when a book is missing.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

There are two main components of the invention. The first main component is a set of two precisely controlled doctor blades that control the amount of glue on the glue wheels, and hence the amount of glue imparted onto the book back, or spine of the book. Each of the doctor blades are controlled by a separate servo motor which allows the precise application of glue spacing and thickness onto the back of the book. The doctor blades, servo motors and related elements are shown in FIGS. 3-9. The second main component is the controlling apparatus that coordinates between the books moving through the binder and the servo motors to precisely time the opening and closing of the doctor blades to precisely position the glue on the spine of the book. These elements are shown in FIGS. 1, 2, 10, & 11, and a flow chart showing the control and operation of the coordinating elements is set forth in FIG. 12. The general operation of the book binding system is described first, then the details of the doctor blade, and finally the operation of the controlling apparatus.

Figure 1:
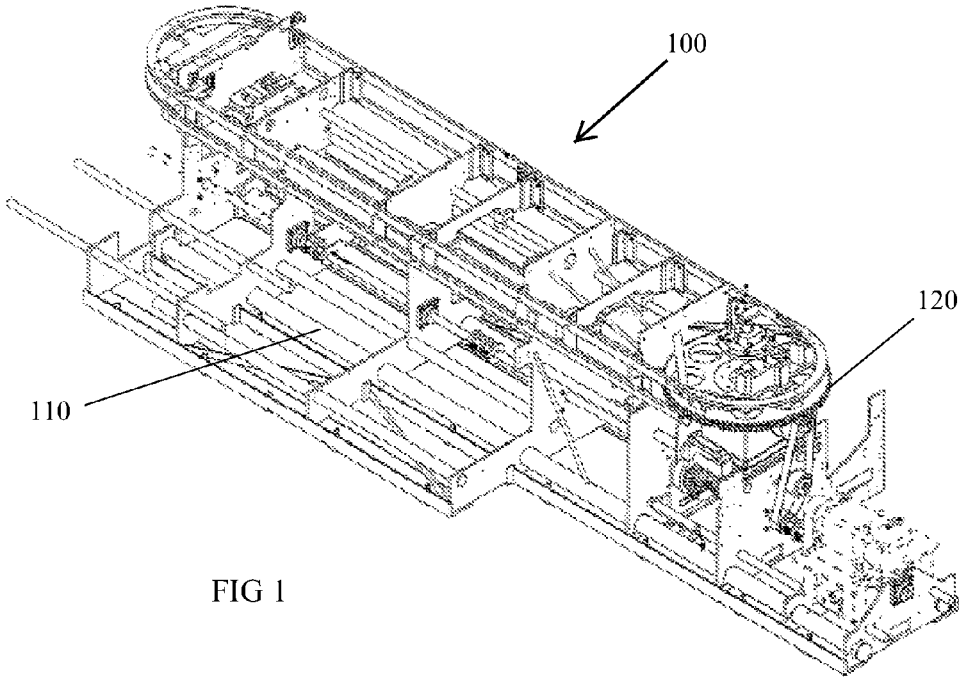
FIG. 1 is a perspective view of a book binding binder frame and binder carriage.

As shown in FIG. 1, the binder 100 consists of a binder main frame 110 and a binder carriage 120. The binder carriage is often called a binder carousel because it rotates around and within the frame 110, but will be referred to herein as the binder carriage 120. There are a number of binder book clamps 130 (or book clamps 130) that are attached around the binder carriage 120. The book clamps 130 are evenly and precisely spaced around the binder carriage 120. The carriage 120 operates in a continuous loop. The operation of the binder machinery is well know, but described here to help define the binder adhesive controller of this application.

Figure 2:
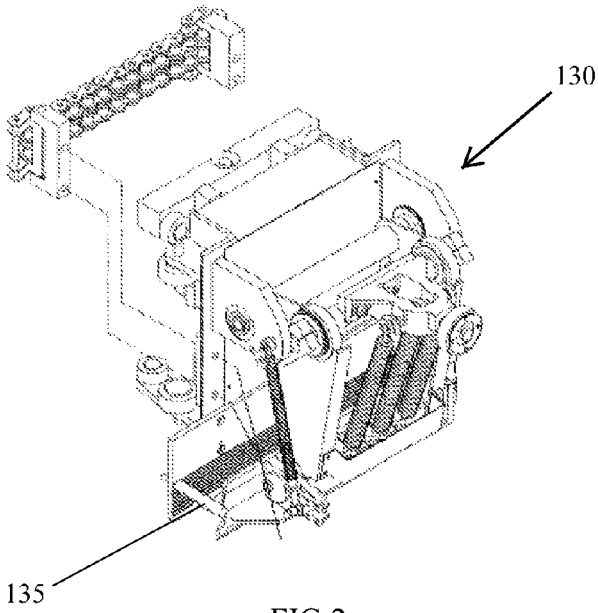
FIG. 2 is a perspective view of a book binding clamp.

At the beginning of the book binding process a group of sheets of paper are collected into the book clamp 130. The book clamp 130 is shown in FIG. 2. The loose sheets of paper, or pages that are collected and held in the book clamp 130, are referred to in the art as a book B, even though once bound many will be catalogues, magazines or other bound publication. The first step of the binding operation is the collection of pages into the book clamp 130. This process is well known, and is not part of this invention. The book clamp 130 then moves to the next stage where the exposed bottom portion of the pages are trimmed so that they are even. This trimmed end, which will be the back of the book, is referred to alternatively as the book back, the backbone, or the spine S of the book. The spine S is then run over the glue wheel 20 for application of the binding glue G. A cover is then placed over the spine S where it is adhered by the glue G. The book clamp 130 then opens and the book B is moved on conveyors where it is further processed, rough edges trimmed, and stacked for shipment. The post glue application process is well known and is not part of the present invention. The book clamp 130 then moves along in the carriage system and picks up another group of loose sheets of paper and the binding operation repeats itself.

Each of the steps of the biding process occurs at a set point in the system, so precise spacing and timing are very important for the successful operation of the binding system. Because of that, the book clamps 130 are evenly and precisely spaced around the binder carriage 120. And because of the need for proper timing, the various steps of the operations, page gathering, spine trimming, gluing, cover application, and book release, occur at precisely located points within the binder frame 110.

Figure 3:
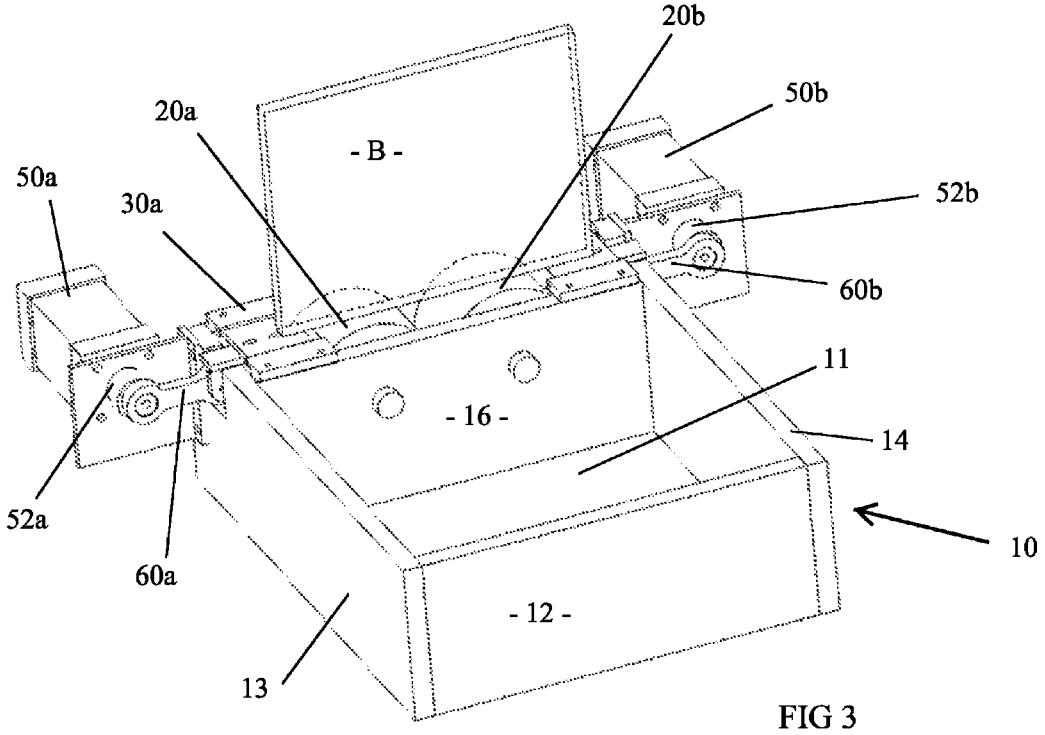
FIG. 3 is a perspective view of the glue pot with servo motors and doctor blades.
Figure 4:
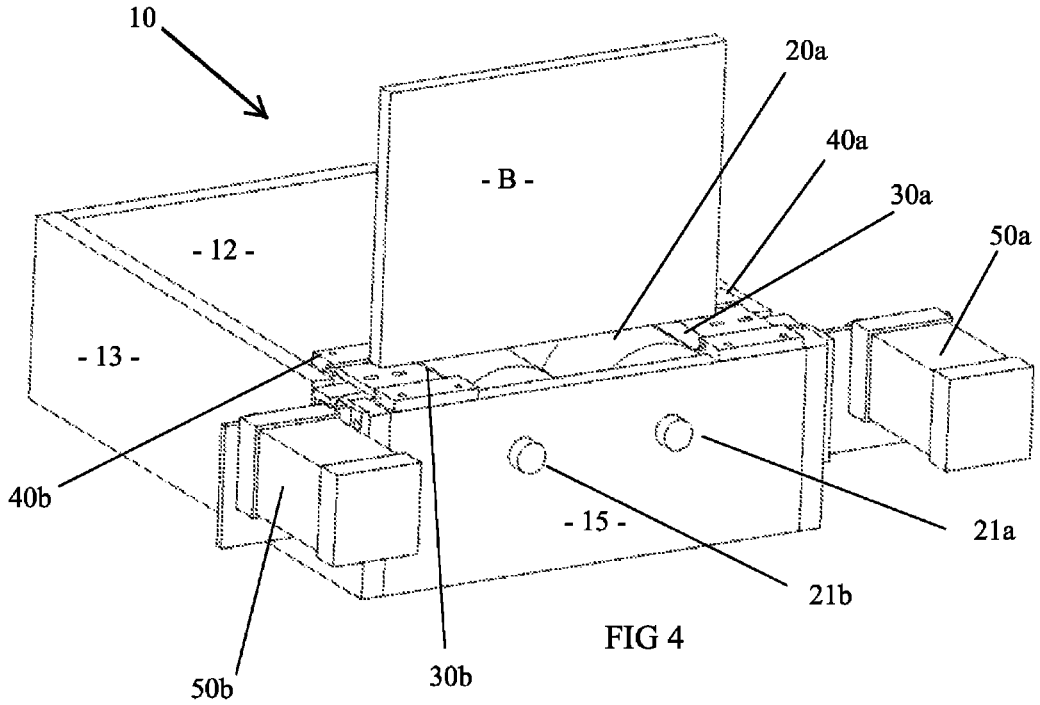
FIG. 4 the back side of the glue pot with a book on the glue wheel for glue application.

FIGS. 3 & 4 are overview drawings showing the main components of the glue pot 10 and glue wheels 20*a* & 20*b* that apply glue G to the spine S of a book B. The components of this portion of the invention are the glue pot 10, the two glue wheels 20*a* and 20*b*, the two paired doctor blades 30*a* and 30*b*, the two servo motors 50*a* and 50*b*, and the two linkages 60*a* and 60*b* that connects the doctor blades 30*a* and 30*b* to the two servo motors 50*a* and 50*b*. In the embodiment disclosed in the figures there are two glue wheels 20*a* and 20*b*, two doctor blades 30*a* and 30*b*, two servo motors 50*a* and 50*b* and two linkages 60*a* and 60*b*. In the configuration shown the two components are mirror images of each other. For simplicity sake only one system will be described, with the understanding that the second system is the mirror image of the first.

The glue pot 10 is a container to hold the glue G. The glue pot 10 is made from a pot bottom 11, a front wall 12, a first side wall 13, a second side wall 14 and a back wall 15. The walls 12, 13, 14 & 15 attach to the bottom in the conventional manner to create a container to hold the glue G. There is also an interior wall 16, that runs from the first side wall 13 to the second side wall 14 parallel to the back wall 15. The interior wall 16 does not attach to the pot bottom 11, leaving a small gap which allows the glue G to flow under the interior wall 16.

The glue G is hot. It is pre-melted and heated in an external tank and then pumped into the glue pot 10 through a tube. There are a set of heating elements in the bottom of the glue pot 10 to keep the glue G at the proper temperature, which is generally between 275° F. to 350° F. The external heating components, delivery tubing and internal heating elements are known in the art and are not show and are not part of the invention.

Figure 5:
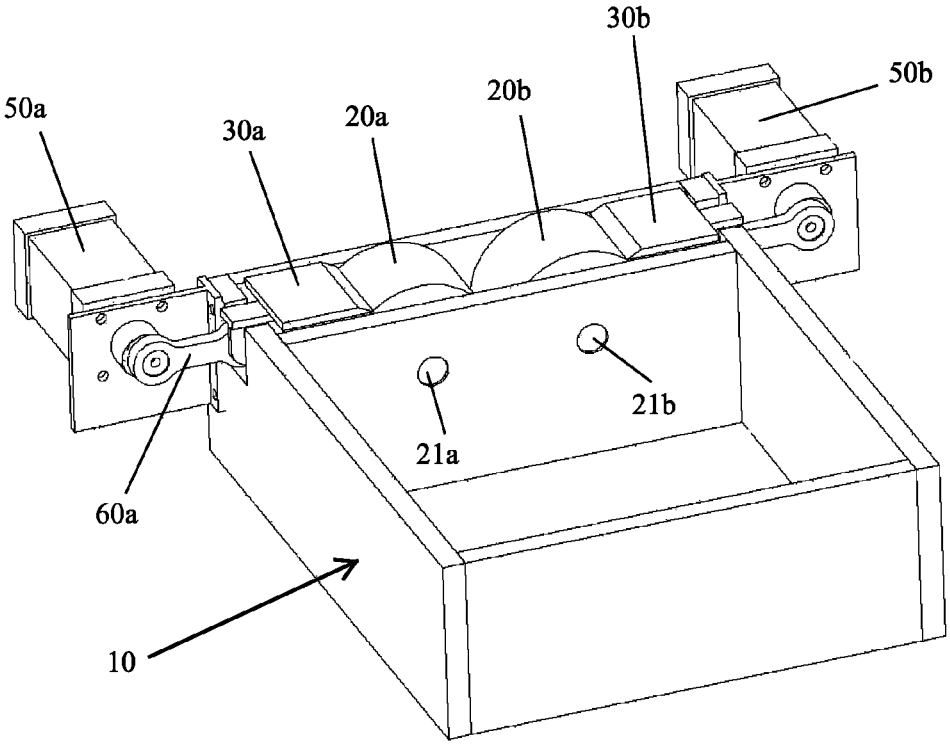
FIG. 5 is a perspective view of the glue pot, the glue wheels, the servo-motors and the doctor blades.
Figure 6:
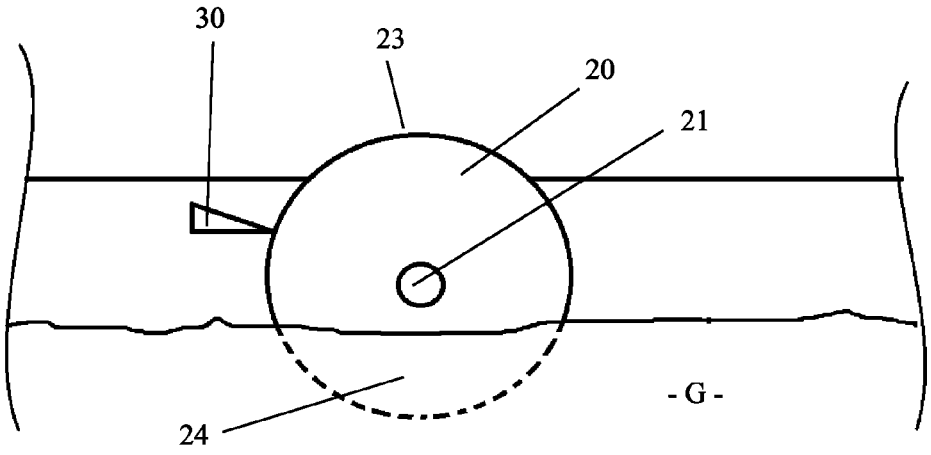
FIG. 6 is a cross section of a glue wheel in the liquid glue, showing the position of the doctor blade in relation to the glue wheel.
Figure 7:
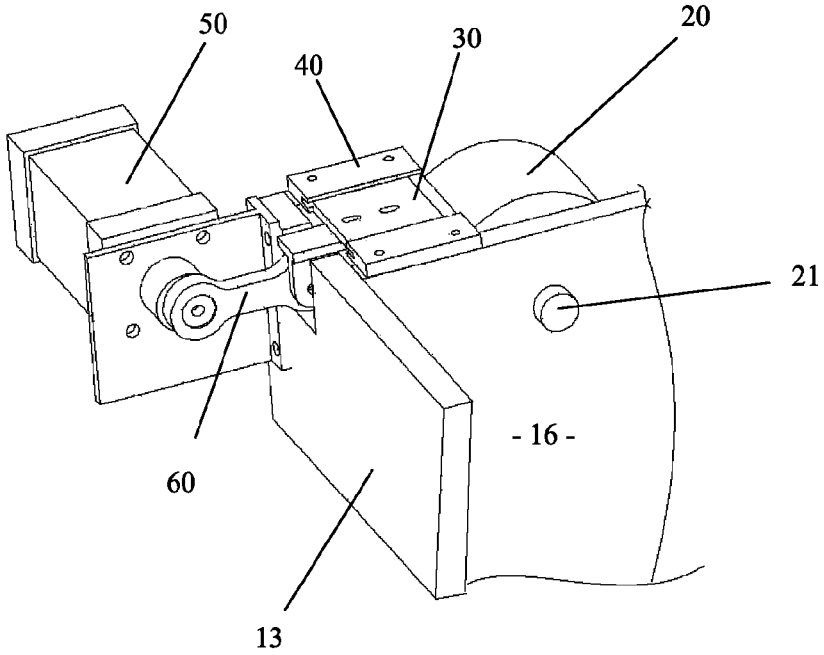
FIG. 7 is a close up perspective detail of the servo motor, the linkage connecting the servo motor to the doctor blade, the doctor blade and the gibs that hold the doctor blade.
Figure 8:
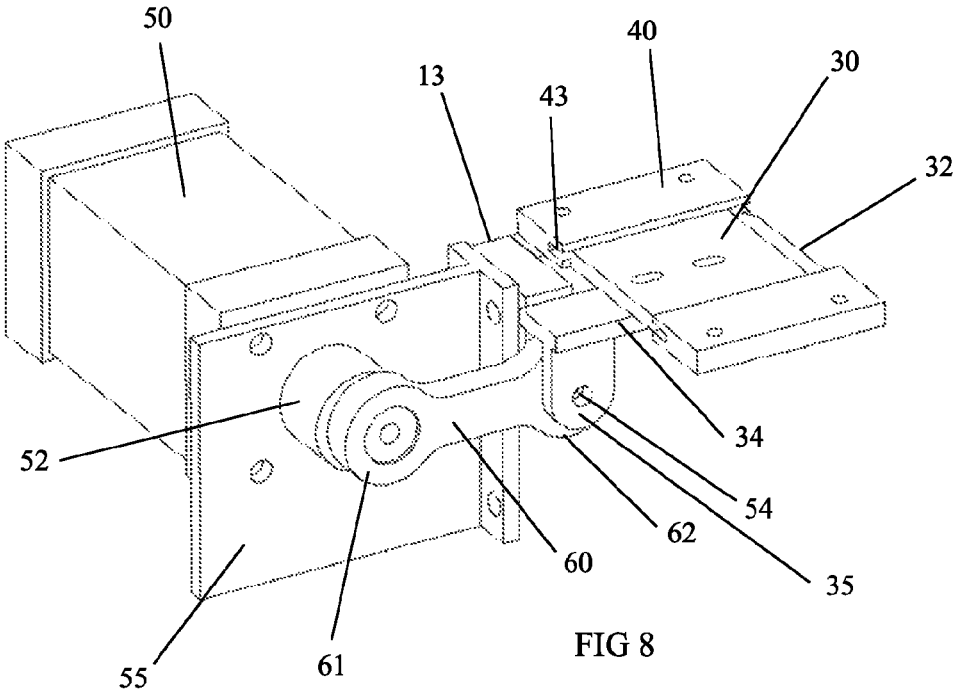
FIG. 8 is a close up of the linkage connecting the doctor blade to the servo motor

As seen in FIG. 5, there are two glue wheels 20*a* and 20*b* that are placed between the back wall 15 and the interior wall 16. The wheels run on glue wheel shafts 21*a* and 21*b* which are attached through shaft holes 25*a* and 25*b* in the back wall 15 and interior wall 16. Each glue wheel 20 turns around its shaft 21. The glue wheels 20*a* and 20*b* are driven from the same drive shaft that controls the binder carriage 120 so that the glue wheels 20*a* and 20*b* are running at the same speed as the binder carriage 120 and hence the books B as they move through the binder 100. This means that the exterior surface 22 of the first glue wheel 20*a* is moving at the same speed as the book back S of the book B. The first wheel 20*a* rolls in the same direction as the movement of the book B and the second wheel 20*b* rolls in the opposite direction. As seen in FIG. 6, the glue wheels 20*a* & 20*b* have a bottom portion 24 that sits in the liquefied glue G, and a top portion 23 which contacts the books B when the spine S of the books B are run across the glue wheels 20*a* & 20*b*. The glue wheels 20 have an exterior surface 22. When the glue wheel 20 bottom portion 24 is in the glue G, a certain amount of glue G will adhere to the exterior surface 22, and as the glue wheel rolls it picks up the glue G which is present on the top portion 23 for application to the spine S of the books B. The movement of the two glue wheels 20 in opposite direction ensures proper glue G application to the book back S. This is the well known application of binding glue G to the spine S.

There are two servo motors 50*a* and 50*b* attached to the side walls 13 & 14 near the back wall 15. The servo motors 50*a* & 50*b* are standard, reciprocating, servo motors, wherein the shaft does not rotate fully but turns a controlled number of degrees. Such servo motors are well known in the art. The servo motor 50 is attached to a mounting plate 55 and the mounting plate 55 is attached to the side wall 13 or 14 near the back wall, as shown in the detail in FIGS. 7 & 8. The servo motor 50 has a shaft 51, and an eccentric cam 52 mounted on the shaft 51. There is a linkage 60 attached to the eccentric cam 52. The linkage 60 has a cam end 61 which is attached to the eccentric cam 52 such that it can roll as the cam 52 moves, and the cam movement forces the linkage 60 to reciprocate back and forth, as described below. The linkage 60 also has a blade end 62 which is mounted to the doctor blade 30 and secured by means of a pin 54.

The doctor blade 30 consists of an attachment arm 35, which is mounted on an attachment plate 34. There is a pin hole 36 in the attachment arm 35, and the pin 54 runs through the attachment hole 36 and attaches the doctor blade 30 to the linkage 60. The doctor blade 30 also has two outwardly extending flanges 33, and a blade edge 32. There are a pair of gibs 40 mounted on the back wall 15 and interior wall 16 near the side wall 13 or 14. The gibs 40 have a recessed channel 43, and the outwardly extending flanges 33 slide in the channels 43. When the doctor blades 30 are slidably mounted in the gibs 40, and with the linkage 60 attaching the doctor blade 30 to the servo motor 50 by means of the eccentric cam 52, the doctor blade 30 will move toward and away from the glue wheel 20.

Figure 9:
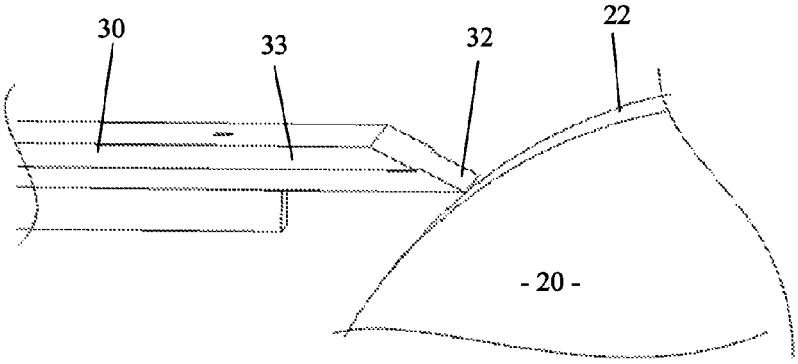
FIG. 9 is a close up detail of the doctor blade in proximity to the exterior surface of the glue wheel.
Figure 10:
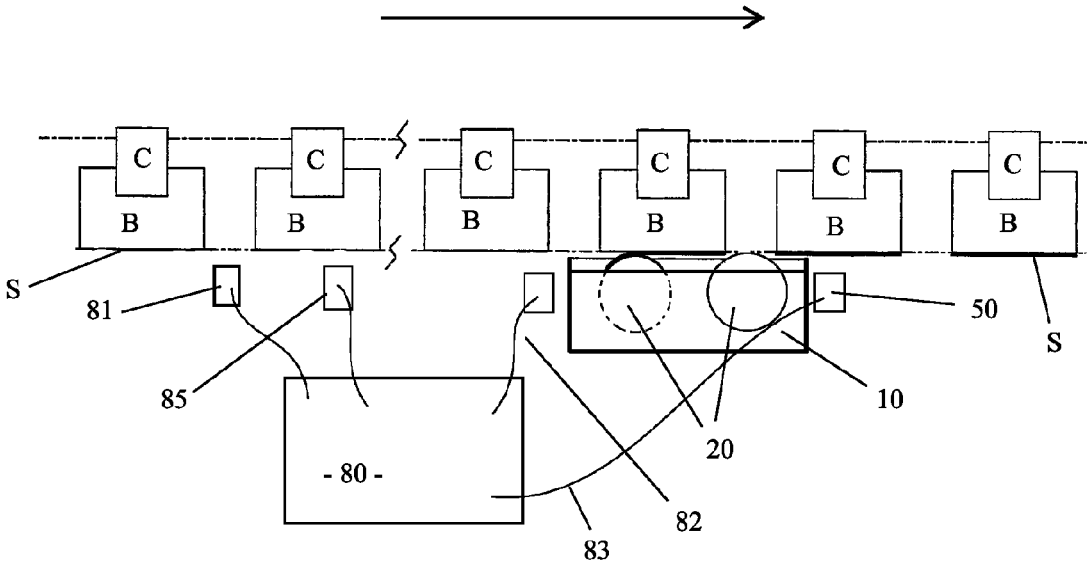
FIG. 10 is a schematic of the control components of the invention, showing the relation between the electric eye, the encoder, the computer controller and the servo motors.
Figure 11:
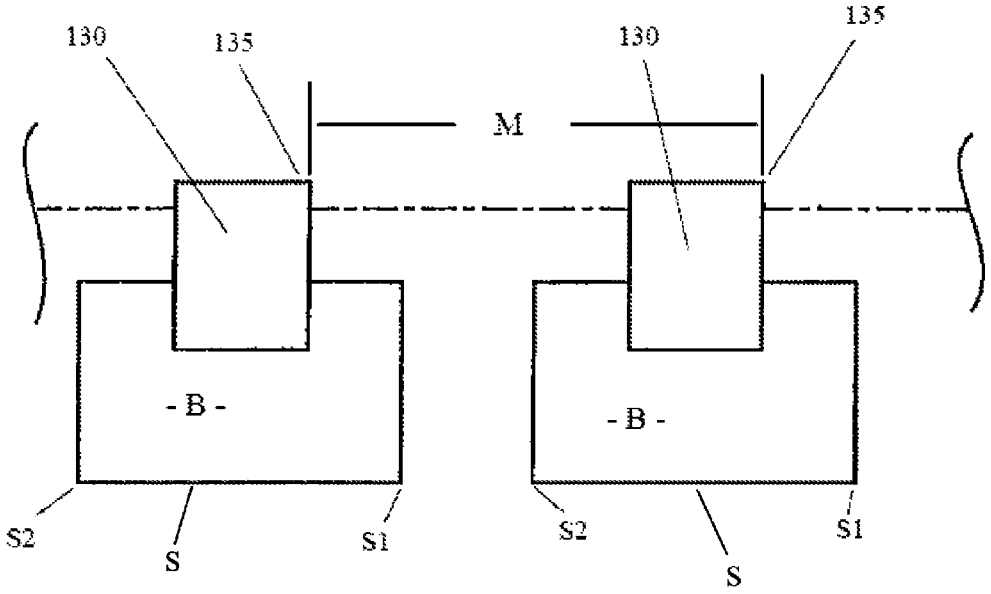
FIG. 11 is a schematic of books in the clamps showing the machine cycle.

FIG. 9 shows the space between the blade edge 32 of the doctor blade 30 and the exterior surface 22 of the glue wheel 20. Were there no doctor blade 30 present, the glue wheel 20 would pick up glue G and transfers it to the spine S of the book B to glue the pages of the book together. The doctor blade 30 prevents excess glue G from being applied to the spine S, and allows the operator to control the thickness of the glue G on the spine S. The reciprocating movement of the doctor blade 30 moves the blade edge 32 into and away from the glue wheel 20. When the blade edge 32 is away from the glue wheel 20 it is in an opened position, and when the blade edge 32 is moved into and close to the glue wheel 20 it is in a closed position. The doctor blade 30 can be controlled so that the opened position controls the thickness of the glue G on the spine S, and can also be precisely controlled to distribute the glue G in the precise location on the spine S. With the eccentric cam 52 moving the doctor blade 30 the blade edge 32 moves from 0.003 inches from the exterior surface 22 of the glue wheel 20 to 0.035 inches from the exterior surface 22. Therefore, when the doctor blade 30 is in the closed position, the blade edge 32 is 0.003 inches from the exterior surface 22. While the blade edge 32 is not touching the glue wheel 20 when in the closed position, this separation is small enough so that little or no glue G will remain on the glue wheel. When the doctor blade 30 is in the opened position the leading edge 32 can be as far as 0.035 inches from the exterior surface 22. This means that a maximum glue thickness of 0.035 inches is applied to the spine S of the book B. Typical glue thickness ranges from 0.018 inches to 0.035 inches thick, and the servo motor 50 allows precise control of the position of the blade edge 32 of the doctor blade 30 in the opened position so that the glue G thickness on the spine S can be precisely set in any thickness between 0.018 inches to 0.035 inches depending upon the binding requirements of the book B. The servo motors 50*a* & 50*b* can precisely control the position of the application of the glue G on the spine S based on the timing and position of the book as it reaches the glue wheels 20*a* & 20*b*.

The binder carriage 120 runs in a continuous loop, and because of this is described, and spaced, as a 360 degree loop. It is called a 360 degree loop even though physically the carriage 120 moves on an elongated racetrack with two parallel sides with two 180 degree turns on each end, as seen in FIG. 1. There can be a number of book clamps 130 attached around the binder carriage 120. There are binders with different numbers of clamps 130 depending on a number of variables, including the overall length of the binder carriage 120 and the size of the book B being bound. The common number of book clamps 130 are 21, 24, 27, and 36, but the actual number can vary. Regardless of the actual number of book clamps 130, the clamps 130 are spaced uniformly around the carriage 120. Since the overall length of the carriage 120 is known, and the number of book clamps will be known once the system is configured, the spacing can easily be determined. In the preferred embodiment there are 27 book clamps 130. Since the carriage loop is 360 degrees, this means that each book clamp 130 is spaced at 13.333 (repeating) degrees around the carriage 120. (360±27=13.333 (repeating)). This means that if the first book clamp 130 is at the zero degree position (position 0), the second book clam will be at position 13.3 (position designation is truncated for simplicity), the third will be at 26.6, the fourth at 40, the fifth at 53.3, and so on around the 360 degree loop.

The position of the book clamp 130 in the binder carriage 120 is measured from a clamp pin 135, which is positioned in the same place on each book clamp 130. The operation of every step in the binding system is timed or spaced off of the position of the clamp pin 135. There is a "0" degree timing mark located on the binder frame 110, and each step of the operation is spaced at a known location, in degrees of movement of the 360 degree carriage loop, from the "0" degree timing mark. This allows the system to be controlled and operated so that each step in the process is done at the correct time. This is done by aligning the clamp pin 135 with the "0" degree timing mark. The binder system operates off of this position, and each step of the position is spaced and time to operate when the book clamp 130 reaches the predetermined position for that step. So the trimming step will occur at a set and known distance from the "0" degree timing mark, and the glue application will occur at a set and known distance from the "0" degree timing mark.

Movement of the binder carriage loop is measured in milliseconds of angular movement, where one full loop is 360 degrees. Each millisecond correlates to a fraction of an inch, with the specific length depending on the overall length of the binder loop and the number of binder clamps in the loop. The binder carriage 120 has 27 clamp 130 positions. In the preferred embodiment these clamp positions are on 18" centers.

When the binder 100 is in operation, the carriage 120 moves continuously. The movement of one book clamp 130 across any step is known as a machine cycle M, which is shown in FIG. 4. In other words, the movement of a first clamp pin 135 of a first book clamps 130 past the "0" degree timing mark through the movement of a second clamp pin 135 past the "0" degree timing mark is one machine cycle M. This means that the physical distance, as well as the angular distance, between the exact same position on each book clamp 130 is known as a machine cycle M, so for example, the distance between the leading edge S1 of a first book and the leading edge S1 of a second book is also the machine cycle M. This allows the binder system to time the operation for each book. This length can be divided into many small even segments to precisely time and control the operation of the various steps in the binding process. So, for example in the preferred embodiment where the machine cycle is 18 inches, and the system breaks this down into 8000 segments, each segment will be 0.00225 inches in length. This allows the very precise timing of each step of the operation. In the preferred embodiment there are 27 clamps spaced at 18 inches, but it is to be understood that there can be a different number of clamps 130, and the distance between clamps 130, the machine cycle M, can be more or less than 18 inches. It should also be understood that the length of the spine S of the book B, from the leading edge S1 to the trailing edge S2 will vary from book to book. It is well known that a book can range from a small paperback (of perhaps four or five inches) to a large size magazine of over 12 inches.

The present invention includes a control system that accurately and precisely controls the thickness of the glue G applied to the spine S, and accurately and precisely controls the spatial application of the glue G along the spine S. The control system does this by accurately and precisely knowing the position of the book clamp 130 in the system, and the spine S within the book clamp 130. This allows the control system to precisely control the position of the doctor blades 30*a* & 30*b* that control the application and thickness of the glue G on the glue wheels 20*a* & 20*b*, and thus the glue G that is applied to the spine S of the book B. Operation of the doctor blades 30*a* & 30*b* and glue wheels 20*a* & 20*b* is described in detail below.

The control system consists of a computerized controller 80, an electric eye 81 that is in electronic communication with the controller 80, and an encoder 85 that is also in electronic communication with the controller 80. These elements are shown in a schematic view in FIG. 10. The computerized controller 80 is a computer that takes input from the various devices, and sends an output signal to the servo motors 50*a* & 50*b*, that control the position of the doctor blades 30*a* & 30*b*. The controller 80 operates on standard industrial software that knows the size of the loop and the distance between binder clamps 130, or machine cycle M, and uses this information to direct the servo motors 50*a* & 50*b*. In the preferred embodiment the controller 80 is a Rockwell Automation 1768 CompactLogix controller with a three-axis integrated motion controller, but any similar industrial computerized controller can be used. The controller 80 includes a computer monitor to allow an operator to input various operation parameters into the system. In the preferred embodiment the monitor is a Panel View Plus touch screen that allows the operator to easily input information, but any computerized input device could be used, including wirelessly connected devices such as a tablet computer. In the preferred embodiment the controller 80 runs Rockwell Automation RSLogix 5000 programming software, but any similar industrial controller software can be used. When the binder system is set up, the system operator inputs the various variables, which include the overall length of the binder carriage 120, the length of the machine cycle M, the number of book clamps 130, the diameter of the glue wheels 20*a* & 20*b*, the location of the doctor blades 30*a* & 30*b* on the circumference of the glue wheels 20*a* & 20*b*, and the length of the spine S. The system operator also inputs the desired glue G thickness and the desired start and stop position of the glue G on the spines, and the controller 80 uses this information to control the servo motors 50*a* & 50*b* as described below.

The electric eye 81 is mounted on the binder frame 110 at the "0" timing mark 115. The electric eye 81 is a standard electric eye and is mounted so that it is triggered by the movement of a book across its field of view. The electric eye 81 is electronically connected to the controller 80 by a standard connecting cable, and tells the controller 80 if there is a book in the book clamp 130. If there is no book in the book clamp 130, the controller 80 will not send a signal to open the servo motors 50*a* & 50*b* and the servo motor will not open the doctor blade 30 when that particular clamp 130 arrives at the glue wheels 20.

There is an encoder 85 that is connected to the binder frame 110 and is in electronic communication with the controller 80. The encoder 85 provides the controller 80 with an encoder signal that has information on the rate of movement of the books B through the binder. In the preferred embodiment the encoder 85 is a simple electromagnetic device that generates a pulse based on the movement of the binder carriage. This pulse is the encoder signal and it is timed to correspond to the movement of the clamps in the binder carriage. This allows the controller 80 to track the movement of the book clamps 130 regardless of the actual speed of the carriage 130. The encoder 85 also allows the controller 80 to divide the machine cycle into many very small parts, based on the timing of each electronic pulse. The encoder 85 pulses for each pre-set segment of the machine cycle M. So if, as in the preferred embodiment, the machine cycle is 18 inches, and the encoder 85 is pre-set in segments of 8000 pulses per machine cycle, this allows the controller 80 to break the 18 inch machine cycle into 8000 equal parts of 0.00225 inches. This means that each pulse of the encoder 85 signifies movement of the carriage 120 of 0.00225 inches. This allows the controller 80 to track and locate the book clamp 130 in 0.00225 inch segments, which allows very precise controlling of the doctor blades 30 and the glue position spatially along the length of the spine S.

The encoder signal allows the controller 80 to know precisely when the leading edge S1 of the book B will come into contract with the first glue wheel 20*a*. With the position information provided by the electric eye 81, and the movement information provided by the encoder 85, the computerized controller 80 can be programmed so that the first doctor blade 30*a* will open at the precisely controlled moment so as to begin the placement of glue G on the glue wheel 20 to allow the precise application of the glue G at the precisely desired point on the book back S. The length of the binder carriage loop is precisely known, the distance between the books B are known, and the encoder 85 and electric eye 81 communicate the position of the book back S to the controller 80, the controller 80 will know precisely when to activate the servo motors 50*a* & 50*b* to open the doctor blades 30*a* & 30*b* to allow the glue G on the glue wheels 20*a* & 20*b* to reach the spine S and the precise position.

If, for example, the glue wheel 20 has a 4 inch diameter it will have a circumference of 12.56637". If the doctor blade 30 is set at the equator of the wheel 20, or at 270 degrees, it must open one quarter turn, or 3.14159" before the glue will be at the top of the glue wheel 20. Typically, however, it is not desirable for the glue G to begin at the leading edge S1 of the spine S, or end precisely at the trailing edge S2, because this will cause glue G to seep over the back edges of the book when the cover is applied. It is preferred to start the glue G on the spine S some distance from the leading edge S1 and stop the glue some distance before the trailing edge S2. For most books B the distance that glue G begins from the leading edge S1 is 3/32 (0.09375") of an inch, and application stops at 3/32 (0.09375") of an inch from the trailing edge S2. This means that the doctor blade 30 will open 3/32 of an inch later than a quarter turn, or will open at 3.04784 inches before the leading edge S1 reaches the top 23 of the glue wheel 20. Because the spacing of the system is known, and programmed into the controller 80, the controller 80 will know when the leading edge S1 of the spine S of the book b will reach the top 23 of the glue wheel for glue application. If glue G is to be applied starting exactly at the leading edge S1, then the doctor blade 30 will open at the precise predetermined point before the hand.

The controller 80 is connected to the first servo motor 50*a* by means of a first communication cable 82 and connected to the second servo motor 50*b* by means of the second communication cable 83. Based on the information inputted into the controller 80 by the operator, the controller 80 will take the information from the electric eye 81 and the encoder 85, process it with the control software, and operate the servo motors 50*a* & 50*b* to precisely open the doctor blades 30*a* & 30*b* to precisely apply the glue to the book back S. The software which is internal to the controller is essentially running off information from the 360 degree loop of the carriage. This means that the software knows that a book will arrive at position 0.0, position 13.3, position 26.6, etc. The software knows the size of the machine cycle M and the spacing in milliseconds (which corresponds to 0.0025 inches). This will allow the software to activate the servo motors 50*a* & 50*b* at the appropriate times.

The operator can input the desired glue thickness, which can range from the closed position of 0.003 inches to the maximum open position of 0.035 inches. Typically the applied glue thickness ranges between 0.018 inches and 0.035 inches depending on the type of book being bound. The controller can also input the length of the book back S, as well as the desired distance from the leading edge S1 of the book B to begin glue application and desired distance from the trailing edge S2 to end glue G application. For most books B the distance that glue G begins from the leading edge S1 is 3/32 (0.09375") of an inch, and application stops at 3/32 (0.09375") of an inch from the trailing edge S2. The system is designed so that the servo motors 50*a* & 50*b* will open the doctor blades 30*a* & 30*b* on the glue wheels 20*a* & 20*b* at precisely the proper time so that as the glue wheel 20 rolls it will have glue G on the wheel for application onto the book back S at the desired point. The doctor blades 30*a* & 30*b* will then close at the desired time so that the glue will no longer be on the glue wheel 20 at the desired distance from the trailing edge S2 of the book B.

As the leading edge S1 of a book B approaches the glue wheel 20*a*, the controller 80 sends a position commands to the servo motor 50*a* to set the thickness of the glue G on the glue wheel 20*a*. The controller 80 can also vary the thickness of the glue G as the book B passes over the glue wheels 20*a* & 20*b*. For example, the glue thickness can be set to be different for each ⅓ of the spine S. The glue thickness can be varied linearly over the length of the spine S of the book B. For example it might have a starting thickness near the leading edge S1 of the book of 0.010 inch and an ending thickness near the trailing edge S2 of 0.020 inch. The glue thickness would decrease to 0.080 when one quarter of the book had passed the glue wheel 20, then decrease to 0.060 inch when one half of the book B had passed the glue wheel 20, and so on.

Figure 12:
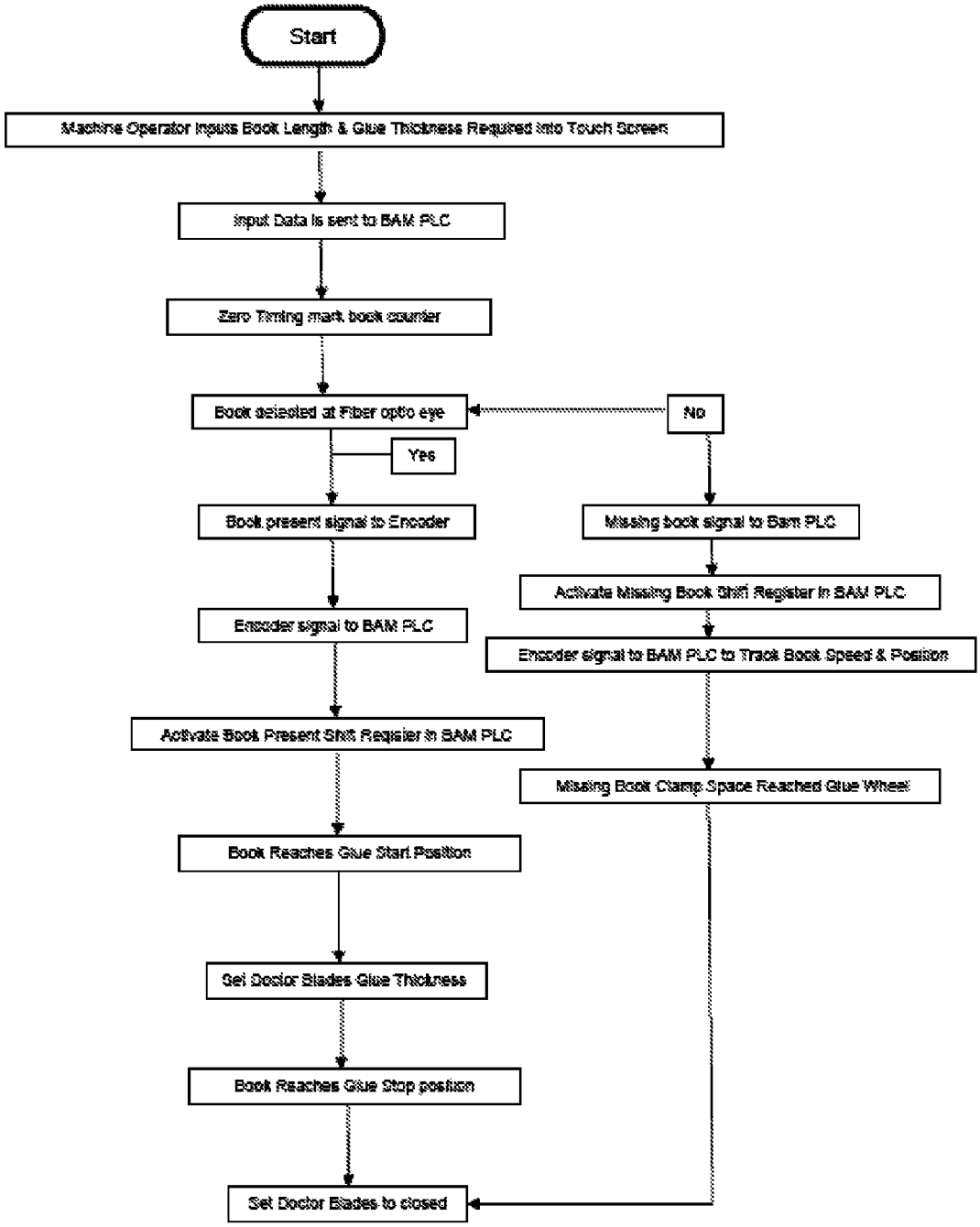
FIG. 12 is a flow chart of the steps that controls the servo motor and doctor blade.

FIG. 12 is a flow chart showing the operation of the control of the doctor blades 30. The operator inputs the desired glue thickness and book length into the computerized controller 80. The operator can also preset the desired distance that the glue starts and stops on the book back S. This information is provided to the component of the controller 80 that controls the servo motors 50. In the preferred embodiment this component is called the BAM PLC. The system is then set by aligning one of the clamp pins 135 with the zero timing mark on the binder frame 110. The system is now aligned and properly times, and the binder carriage 120 can be started. The electric eye 81 will detect the presence of the book B in the clamp 130. If a book is present a signal is sent to the encoder 85 which begins to pulse. If no book is detected the missing book signal is sent to the controller 80. It is know in the art that on occasion the clamp 130 does not properly collect the lose pages and so no book is present. The encoder 85 pulses to show the movement of the book B toward the glue wheel 20. When the book B reaches the glue start position the controller 80 activates the servo motor 50 which manipulates the doctor blade 30 and the desired time so that glue G is applied to the spine S beginning at the desired location, and then moves the doctor blade 30 to the closed position to stop the glue at the desired position.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

I claim:

1. A device for controlling the thickness of glue applied to the spine of a book during the book binding process, said device comprising:

a glue pot having at least two glue wheels therein;

said glue pot holding liquefied glue for application to the spine to bind said book;

said glue wheels positioned in said glue pot such that a bottom portion is immersed in said liquefied glue and a top portion is positioned such that said spine rolls across said glue wheels for application of said glue;

two doctor blades that are movable and positioned near each of the glue wheels to control the thickness of the glue that reaches the top portion of the glue wheel such that it controls the glue applied to the spine of the book;

a book binder that collects paper into a book, holds said book in a clamp such that one edge of said book is the spine, and runs said spine across the top portion of the glue wheels to apply the glue to the spine;

a means for controlling the position of the doctor blades in relation to the glue wheels to control the thickness of the glue applied to the spine and the location of the glue on the spine: for each doctor blade, said means comprising a servo motor having a cam;

a linkage attached between the cam and the doctor blade that allows the servo motor to move the doctor blade to control the position of the doctor blade;

wherein the doctor blade can be moved from a closed position where the doctor blade nearly touches the glue wheel to prevent substantially all the glue on the glue wheel from reaching the top portion of the glue wheel, and an opened position where the doctor blade is away from the glue wheel to allow a desired thickness of glue to reach the top portion of the glue wheel, and means for coordinating the position of the doctor blade with the position of the spine on the glue wheel comprising:

a computerized control system that controls the movement of the servo motor to control the position of the doctor blade;

said computerized control system having an input wherein an operator of the book binding system can input the projected speed of the book binder and hence the speed of the book across the glue wheel, the length of the book back, and the desired thickness of the glue on the book back;

wherein said control system activates the servo motor to turn the cam to move the doctor blade to said opened position to allow glue on the glue wheel as the spine is approaching the glue wheel such that the glue is applied beginning at a precise location on the spine without excess glue on the glue wheel, and said control system activates the servo motor to turn the cam to move the doctor blade to said closed position to stop the application of the glue at a precise location on the spine.

2. The device for controlling the thickness of glue applied to the spine of a book during the book binding process of claim 1 wherein in said closed position the doctor blade is 0.003 inches from the glue wheel.

3. The device for controlling the thickness of glue applied to the spine of a book during the book binding process of claim 1 wherein in said opened position the doctor blade is between 0.018 and 0.035 inches from the glue wheel.

4. The device for controlling the thickness of glue applied to the spine of a book during the book binding process of claim 1 wherein said spine has a leading edge that reaches the glue wheel first, and a trailing edge opposite from said leading edge, and wherein further said precise location of said glue is 0.9375 inches from said leading edge and said trailing edge of said spine.

5. The device for controlling the thickness of glue applied to the spine of a book during the book binding process of claim 1 wherein said computerized control system further includes an electric eye in electronic communication with said computerized control system, wherein said electric eye provides information to said control system indicating whether or not there is a book in a binder, and wherein based on that information the control system will instruct the servo motor to move the doctor blade to the open position.

6. The device for controlling the thickness of glue applied to the spine of a book during the book binding process of claim 1 wherein said computerized control system further includes an encoder in electronic communication with said computerized control system, wherein said encoder measures the movement of the clamp within the binder and provides that movement information to the computerized control system such that the control system can precisely control the operation of the servo motor.

7. A device for controlling the application of glue to the spine of a book during the bookbinding process, said device comprising:

glue wheels coated with glue for application to the spine of the book;

a doctor blade to control the glue on the glue wheels; and a means for controlling said doctor blade to control the glue on the glue wheel, consisting of;

means for coordinating the opening and closing of the doctor blade with the position of the spine of the book at the glue wheel to ensure a desired spatial position of the glue on the book spine;

said means for coordinating consists of;

an electric eye to note the presence of a book in a binder clamp;

an encoder to measure and transmit the movement of the book in the binder clamp through the binding process;

a computerized controller having position information for the glue wheel and the moving position of the spine of the book;

a servo motor attached to said doctor blade to control the movement of the doctor blade, said servo motor moving said doctor blade from a closed position wherein said doctor blade is close to said glue wheel to prevent glue from reaching the spine of the book to an opened position wherein glue is allowed to remain on the glue wheel to be imparted on the spine of the book; the glue wheels rotating in opposite directions.

8. The device of claim 7, wherein in said closed position said doctor blade is 0.003 inches from the glue wheel.

9. The device of claim 7, wherein in said opened position said doctor blade is 0.035 inches from said glue wheel.

10. The device of claim 7, wherein said servo motor can control the open position between 0.018 to 0.035 inches from said glue wheel.

11. A device for controlling the application of glue to the spine of a book in the bookbinding process, said device comprising:

a glue pot for holding glue;

a glue wheel place in said glue pot such that said glue wheel will pick up glue when present in the glue pot;

a binder carriage holding a multiplicity of binder clamps;

said binder clamps holding a stack of pages to be bound into a book, wherein the portion of the stack of pages extending from said binder clamp will create a spine of a book after the application of the glue;

wherein said binder carriage moves said binder clamps through said system such that said spine of said book moves across a top portion of said glue wheel such that said glue is applied to said spine of said book;

a doctor blade for controlling the glue on said glue wheel, said doctor blade positioned in close proximity to said glue wheel and having a means for adjusting the position of said doctor blade to prevent the presence of glue on the top portion of the glue wheel and to control the thickness of the glue on the top portion of the glue wheel;

said means for adjusting the position of said doctor blade consisting of a servo motor attached to said doctor blade, wherein said servo motor can move the doctor blade from a closed position that prevents glue on the glue wheel from reaching said top portion of said glue wheel to an opened position that allows glue on the glue wheel to reach said top portion of said glue wheel and can control the position of said doctor blade between said closed position and said opened position to control the thickness of the glue on the top of the glue wheel;

a control system for monitoring the position of the binder clamps within said binder carriage and in communication with said means for adjusting the positioning of said doctor blade such that the doctor blade can be opened and closed to precisely position the glue on the spine of the book;

said control system consisting of an electric eye to monitor the presence of a book in one of the binder clamps, an encoder to monitor the movement of the binder clamps in the system, and a control device in electronic communication with said electric eye and said encoder, and in further electronic communication with said servo motor;

wherein said control device consists of a computer running industrial operations software, and wherein said control device is provided parameters of operation including the size of the binder carriage, the number of binder clamps in said binder carriage, the spacing between binder clamps, the size of the spine of the book within the binder clamp, and the position of the top of the glue wheel, and wherein further said electric eye indicates to the control device the presence of a book in a book clamp, and said encoder provides movement of the binder clamp to the control system, and wherein said control system determines when to open said doctor blade based on the position of said book spine in relation to said top of said glue wheel, and wherein further said control system sends a control signal to said servo motor and said servo motor moves said doctor blade to said open position to impart glue on said book spine at said desired position, and wherein said control system sends a control signal to said servo motor and said servo motor moves said doctor blade to said closed position to stop the glue from reaching the top of said glue wheel and thus stop the glue at a desired position on said book spine; wherein there are two identical glue wheels, the glue wheels rotating in opposite directions.

* * * * *